US006207016B1

(12) United States Patent
Ekström

(10) Patent No.: US 6,207,016 B1
(45) Date of Patent: Mar. 27, 2001

(54) METHOD FOR DIVIDING A PAPER WEB

(76) Inventor: Lars Ekström, Rådhusgatan 7, SE-532 30 Skara (SE)

( * ) Notice: Subject to any disclaimer, the term of this patent is extended or adjusted under 35 U.S.C. 154(b) by 0 days.

(21) Appl. No.: 09/312,413

(22) Filed: May 14, 1999

Related U.S. Application Data

(60) Provisional application No. 60/091,670, filed on Jul. 2, 1998.

(30) Foreign Application Priority Data

May 14, 1998 (SE) ..... 9801683

(51) Int. Cl.[7] ..... D21F 11/00

(52) U.S. Cl. ..... 162/194; 162/111; 162/193; 162/195; 162/286

(58) Field of Search ..... 162/120, 193–195, 162/111, 280–281, 285–286, 198–199; 83/277, 53; 15/93.1, 104.16, 236.01

(56) References Cited

U.S. PATENT DOCUMENTS

| | | | |
|---|---|---|---|
| 1,279,756 | | 9/1918 | Pope . |
| 2,686,463 | | 8/1954 | Beloit . |
| 2,709,398 | | 5/1955 | Beachler . |
| 2,857,822 | | 10/1958 | Heys . |
| 3,065,486 | * | 11/1962 | Scott ..... 162/281 |
| 3,652,390 | | 3/1972 | Peterson . |
| 4,192,709 | | 3/1980 | Dunlap . |
| 4,560,438 | | 12/1985 | Tell et al. . |
| 4,566,944 | | 1/1986 | Mauranen et al. . |
| 5,021,124 | * | 6/1991 | Turtinen et al. ..... 162/199 |

FOREIGN PATENT DOCUMENTS

| | | |
|---|---|---|
| 0 496 139 A1 | 7/1992 | (EP) . |
| 0 654 101 B1 | 5/1995 | (EP) . |

* cited by examiner

*Primary Examiner*—Jose Fortuna
(74) *Attorney, Agent, or Firm*—Alston & Bird LLP

(57) ABSTRACT

A method of dividing a formed paper web into at least two partial-width webs during production of creped paper in a paper machine having a cylinder with an adhesive coating to which the web adheres. The web is divided in conjunction with the cylinder by one partial-width web being detached by scraping from the outer surface at a first web-detaching point while the other partial-width web, still adhered to the outer surface, accompanies this surface to a second web-detaching point situated downstream, to be detached by scraping from the outer surface, at least one partial-width web being creped off.

11 Claims, 3 Drawing Sheets

METHOD FOR DIVIDING A PAPER WEB

CROSS-REFERENCE TO RELATED APPLICATIONS

This application claims the benefit of U.S. Provisional Application Ser. No. 60/091,670, filed Jul. 2, 1998.

FIELD OF THE INVENTION

The present invention relates to a method and apparatus for dividing a formed paper web into at least two partial-width webs.

BACKGROUND OF THE INVENTION

A paper web formed in a paper machine has varying width and its edges are uneven as regards straightness, thickness and grammage. It is therefore necessary to edge-trim the paper web during some part of the manufacturing process. A number of different techniques have been proposed in order to achieve a paper web with straight edges and having predetermined width.

One known technique for edge-trimming a formed paper web is to trim the edges from the web when the finished, reeled paper web is rewound in a rewinder. The waste of dried paper that is formed during this edge-trimming is extremely voluminous, which complicates its collection and removal to be re-dissolved in water and returned to the paper manufacturing process.

According to another known technology, edge-trimming occurs in the paper machine at a point between the drying section and the reel-up, with the aid of high-pressure water jets, air jets, rotating knives, or rotating saw blades. This technology thus requires installation of extra equipment in the extremely limited space available between the drying section and the reel-up.

According to yet other known technology, the edge trimming occurs in the wet section of the paper machine, before the drying section. For example, it is known from U.S. Pat. Nos. 2,686,463 and 2,709,398 to trim the edges of a paper web on a fourdrinier wire with the aid of water jets so that it is divided into an edge-trimmed web, and couch trimmings, after which the edge-trimmed web is removed from the wire for transfer to the drying section, while the couch trimmings are prevented from reaching the drying section. However, it has been found that this technology cannot be used for paper grades having low grammages, such as soft paper, since the couch trimmings adhere to the pickup felt used for removing the edge-trimmed web and therefore tend to accompany it to the drying section.

In a twin wire former it is in practice known to perform edge trimming of the paper web while it is supported by one of the forming fabrics at a point immediately before the pickup means. Water jets are generally used for edge trimming, these jets encountering the paper web with relatively high pressure to produce an edge trimming and an edge-trimmed web. One drawback is that, after having divided the paper web, the water jets spread, splashing water around the whole area. If the supporting fabric is a felt, as in the case of a crescent former, there is considerable risk of fibers and fiber fragments being pressed into the felt. The pressure of the water jets must be limited in order to reduce the risk of their damaging the felt. In spite of these measures, however, the water jets gradually cause wear on the felt and this wear may affect the paper web, causing edge rupture and consequent risk of web rupture. The felt also becomes wetter along the dividing lines formed by the water jets than over the rest of the felt, which may cause problems since the drying cylinder becomes wetter opposite these dividing lines than over other parts of the outer surface of the drying cylinder, thereby incurring problems with corrosion and deposits. The water jets from the jet tubes may also easily cause the paper edge to thicken around the water jets and this thickening may result in deterioration of the adhesion to the drying cylinder at the edge portions of the paper web. The outer surface also becomes hotter opposite the dividing lines, which may cause the paper web to become detached from the outer surface. To solve these problems and provide a paper web with straight edges and of a predetermined width in a crescent former, therefore, the outer forming fabric may be provided with impermeable edge portions, as described in U.S. Pat. No. 3,652,390. The inner parallel edges of said edge portions facing each other thus determine the width of the finished paper web, and the width is chosen dependent on the grade of soft paper to be manufactured. When the manufacture of soft paper is to be changed from one grade to another, for example from tissue to toweling paper, the width of the finished paper must be changed in order to avoid undesirable losses during conversion of the paper web to the desired final products. To enable such a change in manufacture from one paper type to another, the outer forming fabric of the crescent former must be dismantled and replaced by another forming fabric with a different width between the impermeable edge portions. This exchange is laborious, time-consuming, and entails undesired loss of production. Increased costs for forming fabrics are also incurred, as well as space for their storage.

To solve the problems inherent in the technologies used in the twin-wire former described, EP-0 654 101 proposes cutting a paper web formed in a twin-wire former with a jet cutter at a point on the forming roll where the recently formed paper web and the forming fabrics together enclose the forming roll in a sandwich structure. This technology entails a limitation of the choice of forming wires since the water jets must have sufficient force to pass through the wire and the paper web. There is then a risk of the surface of the opposite felt being damaged. The felt also becomes wetter at the dividing lines formed by the water jets than at other parts of the felt, which may cause problems since the drying cylinder becomes wetter opposite these dividing lines than other parts of the outer surface of the drying cylinder, thus involving problems of corrosion and deposits. The outer surface also becomes hotter opposite the dividing lines, which may cause the paper web to become detached from the outer surface.

U.S. Pat. Nos. 1,279,756, 2,857,822 and 4,560,438 disclose still other examples of methods and apparatus for edge trimming in a paper machine before the drying section.

Slitter-winders are used for dividing a paper web in the longitudinal direction, in which slitter-winder the narrower webs obtained through longitudinal slitting are wound to reels. Dividing a paper web through longitudinal slitting can also be performed in the paper machine at a point between the drying section and the reel-up using equipment similar to that used in the edge trimming described above, in the same position.

SUMMARY OF THE INVENTION

The present invention seeks to reduce the aforementioned problems in the known technologies for edge trimming a paper web, and to provide a method and apparatus for dividing a web by a completely new technique making it possible to divide the paper web into two or more partial-width webs and/or to trim edge portions from a formed paper web.

A method according to one preferred embodiment of the invention is characterized in that the formed paper web is divided in its longitudinal direction in conjunction with a cylinder about which the web is circumferentially wrapped and to which the web is affixed, wherein one partial-width web is detached by scraping from the outer surface of the cylinder at a first web-detaching point while the other partial-width web, still adhered to the outer surface, accompanies said surface to a second web-detaching point circumferentially spaced from said first web-detaching point, to be detached by scraping from the outer surface of the cylinder. Thus, the two partial-width webs are removed from the cylinder at different times and, accordingly, the web is divided along a dividing line between the two partial-width webs. Preferably, at least one partial-width web is simultaneously creped while being detached, in order to obtain a creped paper web of predetermined width. The cylinder preferably comprises a drying cylinder included in a drying section of a paper machine.

An apparatus for dividing a running fibrous web in accordance with a preferred embodiment of the invention comprises a rotating cylinder having an outer surface adapted to have the web wrapped circumferentially thereabout and be adhered thereto such that rotation of the cylinder carries the web along the running direction, and at least first and second doctor blades engaging the outer surface of the cylinder for removing the web therefrom. The first doctor blade forms a first web-detaching point for removing one partial-width portion of the web from the cylinder and the second doctor blade is circumferentially spaced from the first doctor blade and forms a second web-detaching point for removing another partial-width portion of the web from the cylinder. Accordingly, the two partial-width portions of the web are removed from the cylinder at different times such that the web is divided into the two partial-width portions along the dividing line therebetween.

Advantageously, one or both of the doctor blades is a creping doctor blade operable to crepe the partial-width portion removed thereby. In accordance with a further preferred embodiment of the invention, the first doctor blade forming the first web-detaching point is a creping doctor blade having at least two scraping edges arranged one after another along a length direction of the cylinder, adjacent scraping edges being spaced apart along the length direction so as to form a recess therebetween allowing a partial-width web to remain adhered to the cylinder and be carried by the cylinder to the second doctor blade to be scraped off in the form of an intermediate trimming. Thus, two creped partial-width webs are formed at the same circumferential position of the cylinder, and the intermediate trimming separating the two partial-width webs is removed subsequently. In one embodiment, the first doctor blade includes at least two parts each having a scraping edge and being spaced apart to form the recess. Alternatively, the first doctor blade comprises an integral piece defining the recess and a scraping edge on each side of the recess.

The first doctor blade can have an overall width less than the width of the web and can be positioned relative to the web such that two opposite edge portions of the web are left adhered to the cylinder when the web passes the first web-detaching point, and the second doctor blade can be constructed and arranged to remove the two edge portions and the intermediate trimming from the cylinder.

The invention in a further preferred embodiment provides an apparatus for forming creped paper, comprising a rotating drying cylinder adapted to receive a wet formed paper web, the drying cylinder having an outer surface adapted to have the web wrapped circumferentially thereabout, a transfer roll in operative engagement with the drying cylinder for transferring the paper web onto the outer surface of the drying cylinder, an adhesive applicator constructed and arranged to apply adhesive to the outer surface of the drying cylinder for adhering the paper web thereto, and at least first and second doctor blades engaging the outer surface of the cylinder for removing the web therefrom. The first doctor blade forms a first web-detaching point for removing one partial-width portion of the web from the cylinder and the second doctor blade is circumferentially spaced from the first doctor blade and forms a second web-detaching point for removing another partial-width portion of the web from the cylinder, at least one of the doctor blades being operable to crepe the partial-width web removed thereby.

BRIEF DESCRIPTION OF THE DRAWINGS

The invention will be described in more detail with reference to the drawings.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
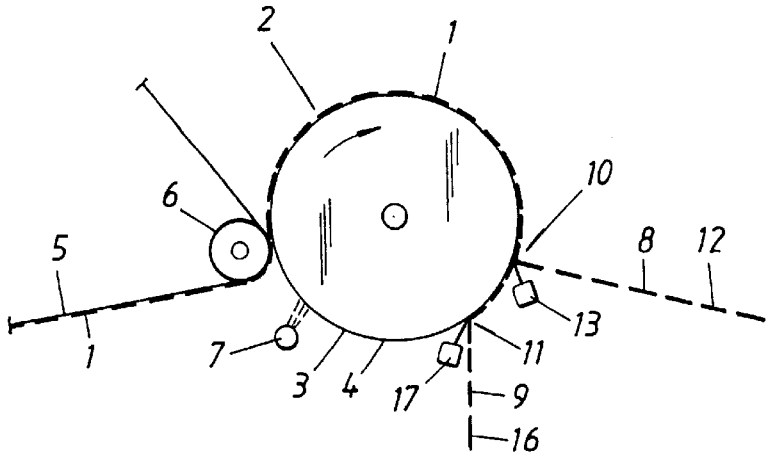
FIG. 1 is a side view of part of a paper machine with a drying cylinder and a apparatus according to a first embodiment of the invention.
Figure 2:
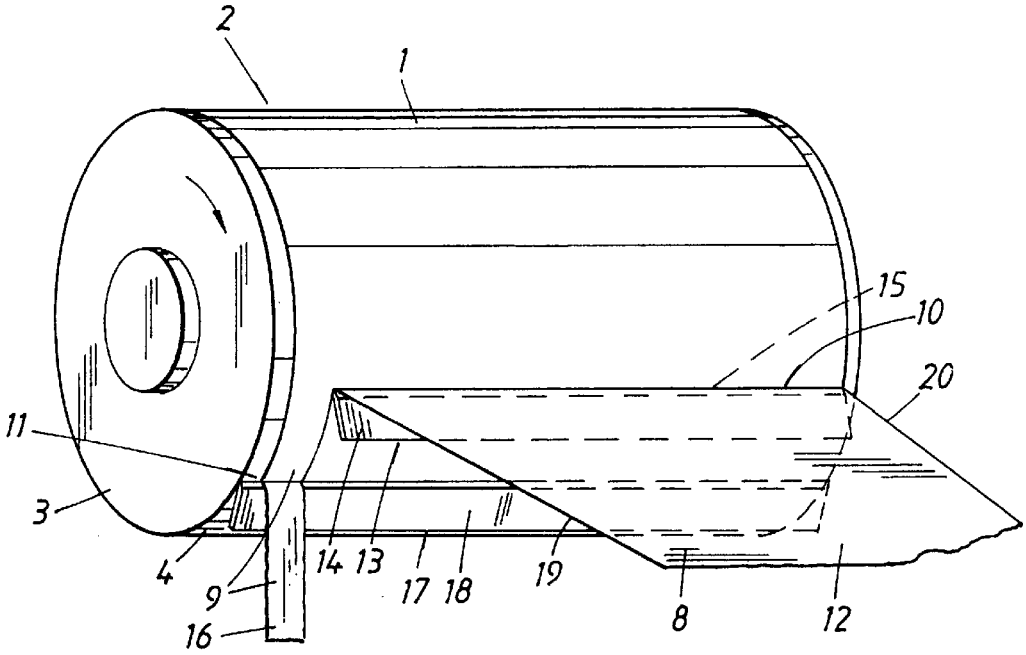
FIG. 2 is a perspective view of the drying cylinder and the apparatus according to FIG. 1.

FIGS. 1 and 2 show schematically part of a paper machine for manufacturing creped paper, e.g. soft paper. The paper machine comprises a wet section (not shown) for forming a paper web 1, a press section (not shown) for dewatering the formed paper web, and a drying section 2.

The drying section 2 includes a cylinder 3 rotating in the direction indicated by the arrow and which in the embodiments shown is a drying cylinder, for example a Yankee dryer surrounded by a hood (not shown). The drying cylinder 3 has an outer surface 4 which forms an endless, moving creping surface. The drying cylinder 3 has an upstream side where the formed paper web 1 is conveyed to the drying cylinder 3 from a transfer fabric 5 running around a transfer roll 6 which forms a nip with the drying cylinder 3 and a downstream side where the formed paper web 1 is treated in accordance with the present invention.

The outer surface 4 of the drying cylinder 3 has an adhesive coating to which the formed paper web 1 adheres during its movement, carried by the drying cylinder 3. To maintain the adhesive coating, application apparatus 7 are arranged before the nip between the transfer roll 6 and the drying cylinder 3 to apply a suitable adhesive and possibly other chemicals on the outer surface 4 of the drying cylinder. Alternatively, at least part of the adhesive may be applied to the lower side of the formed paper web 1 before this is brought into contact with the drying cylinder 3.

The adhesives currently particularly useful for performance of the invention are water-based polymers which, together with substances in the stock, produce a protective layer on the drying cylinder, and also surface active substances. Inorganic chemicals may be added to adjust the adhesion. The adhesive is normally used in a quantity of about 0.1–1 kg/ton dry, finished paper. The appearance of the creping can be altered by varying the composition of the adhesive, which also produces a corresponding change in the paper grade.

The coating obtained by the adhesive applied, particularly of the type mentioned above, protects the outer surface of the cylinder from wear due to the action of the doctor blade. Doctors of ceramic material may be used to further reduce the risk of wear on the outer surface. For the same reason, doctor blades, regardless of whether they consist of acid-proof, ceramic, or other material, may be arranged oscillating, e.g., with 2 mm oscillation.

According to the present invention, the formed paper web 1 is divided in longitudinal direction into at least two partial-width webs in connection with the drying cylinder 3 at its downstream side.

In the embodiment shown in FIGS. 1 and 2, the formed paper web 1 is divided into two partial-width webs, namely a first partial-width web 8 and a second partial-width web 9, by the first partial-width web 8 being detached by scraping from the outer surface 4 of the cylinder 3 at a first web-detaching point 10 while the other partial-width web 9, still adhered to the outer surface 41, accompanies this surface to a second web-detaching point 11 which, in circumferential direction, is situated at a predetermined distance from the first web-detaching point 10. The second partial-width web 9 is detached by scraping from the outer surface 4 of the cylinder 3. In the embodiment according to FIGS. 1 and 2, the first partial-width web 8 is simultaneously creped while being detached, in order to obtain a creped paper web 12 of predetermined width. For this purpose, the first web-detaching point 10 includes a creping doctor 13 having a doctor blade 14 arranged in scraping contact with the outer surface 4, or more specifically with the adhesive coating on the outer surface. The doctor blade 14 has a continuous scraping edge 15 with an active length corresponding to the width of the creped paper web 12. The scraping edge may extend outside the formed paper web, but this extension is then inactive. In the embodiment according to FIGS. 1 and 2, the second partial-width web 9 is detached without creping and thus constitutes an edge trimming 16 which is conveyed down into a container or area to be returned for dissolving and re-use in the paper-manufacturing process. The second web-detaching point 11 includes a cleaning doctor 17 with a doctor blade 18 for scraping off the edge trimming 16 from the adhesive coating on the outer surface 4. The doctor blade 18 of the cleaning doctor 17 extends between the ends of the drying cylinder 3 in order to smooth out the adhesive coating after its contact with the formed paper web 1. If desired, a shorter doctor may be used to scrape off the edge trimming 16, in which case the length of the active scraping edge of the doctor blade corresponds to the width of the edge trimming 16. In this case, a cleaning doctor may be arranged downstream of the second web-detaching point 11 if desired.

In the embodiment according to FIG. 2, the creped paper web 12 obtains a straight edge 19 due to the dividing procedure described above, which in this case constitutes edge-trimming on one side, the other edge 20 remaining unaffected, which may be acceptable in some circumstances. If desired, or deemed necessary, the other edge 20 may consist of an edge previously trimmed in the wet section, which has been achieved by any known technology. Alternatively, such optional trimming may be performed after the drying cylinder in accordance with some known technology.

Figure 3:
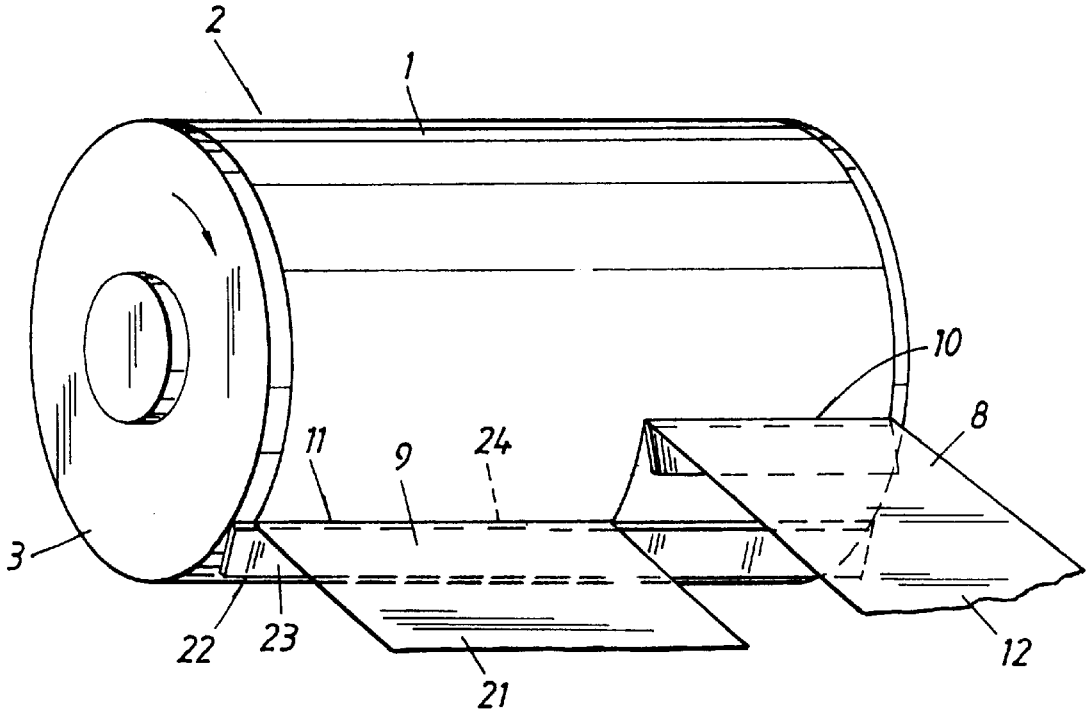
FIG. 3 is a perspective view of a drying cylinder with a apparatus according to a second embodiment of the invention.

In the embodiment according to FIG. 3, the formed paper web 1 is divided in the same way as in the embodiment according to FIG. 2, but the second partial-width web 9 is also creped off the outer surface in order to obtain a second creped paper web 21 of predetermined width. The two creped paper webs 12 and 21 may have the same width or different widths. The creping doctor 13 is thus shorter in this case than in the embodiment according to FIG. 2. The second web-detaching point 11 in this case has a creping doctor 22 with a doctor blade 23 arranged in scraping contact with the outer surface 4, or more specifically with its adhesive coating. The doctor blade 23 has a continuous scraping edge 24 with an active length corresponding to the width of the creped paper web 21. If desired, a cleaning doctor may be arranged downstream of the second creping blade 22. The same applies to the outer web edges not affected by the dividing process as explained for the edge 20. A special feature of this embodiment according to FIG. 3 is that two creped paper webs 12, 21 are obtained with different dry solids content as a result of the longer time the second partial-width web 9 remains in contact with the hot outer surface 4. According to an alternative of the embodiment shown in FIG. 3, three or more (e.g., a number n) creping doctors are arranged stepwise one after the other, i.e., displaced axially and circumferentially, in order to obtain three or more creped paper webs, in which case two (or n−1) dividing lines are formed. The lengths of the doctor blades may be the same or different and together they cover the width of the formed paper web 1 possibly minus the width of one or two edge trimmings which may be achieved as shown for the embodiment in FIG. 2. This, therefore, constitutes another alternative embodiment (not shown) of the invention.

Figure 4:
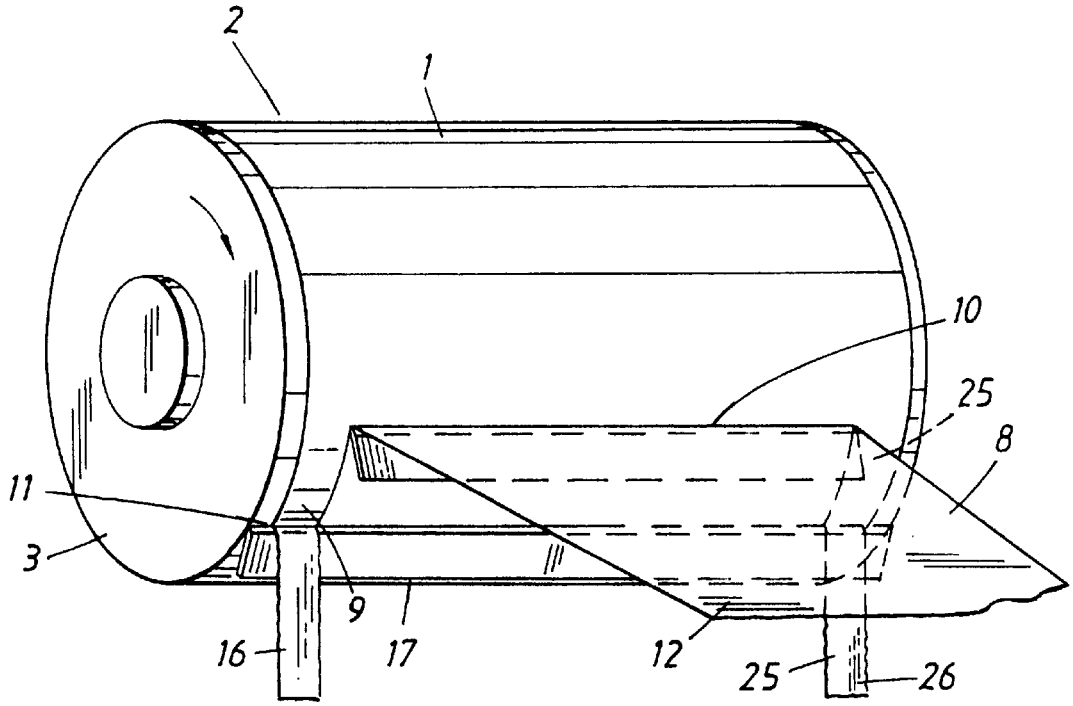
FIG. 4 is a perspective view of a drying cylinder with a apparatus according to a third embodiment of the invention.

Three partial-width webs are produced in the embodiment according to FIG. 4, the first partial-width web 8 and the second partial-width web 9 being similar to those in the embodiment according to FIG. 2, while the third partial-width web 25 is similar to said second partial-width web 9 and thus constitutes a second edge trimming 26. The cleaning doctor 17 is used here to scrape off both edge trimmings 16,26. In the embodiment according to FIG. 4, a creped paper web 12 of predetermined width is obtained, which is trimmed along both sides.

Figure 7:
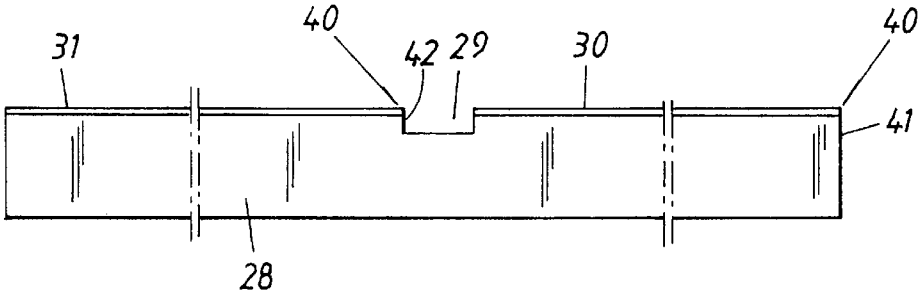
FIG. 7 shows a doctor blade included in a creping doctor used in the embodiment according to FIGS. 5 and 6.
Figure 5:
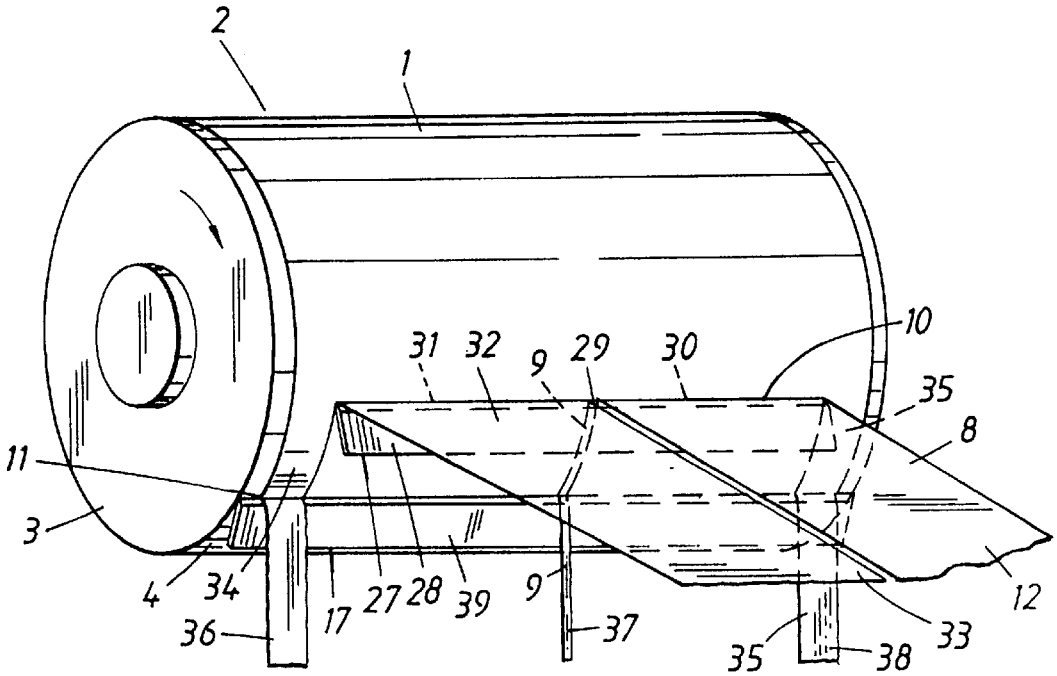
FIG. 5 is a perspective view of a drying cylinder with a apparatus according to a fourth embodiment of the invention.

The embodiment according to FIG. 5 is similar to that according to FIG. 4, but includes a creping doctor 27 the doctor blade 28 of which is provided with a free space in the form of a U-shaped recess 29, seen more clearly in FIG. 7, so that the doctor blade 28 has two continuous scraping edges 30,31. The formed paper web 1 is in this case divided into five partial-width webs, the first partial-width web 8 and the third partial-width web 32 being creped off at the first web-detaching point 10 at an axial distance from each other in order to obtain two creped paper webs 12,33 of the same width or different predetermined widths, while the second partial-width web 9 formed between the first partial-width web 8 and the third partial-width web 32 by the double dividing, and the fourth partial-width web 34 and the fifth partial-width web 35, still adhered to the outer surface 4, accompany said surface to the second web-detaching point 11 to be detached by a common doctor blade 39 to obtain a first edge trimming 36, an intermediate trimming 37 and a second edge trimming 38. The recess 29 or other free space has an axial dimension of at least 5 mm, preferably at least 10 mm, and a depth perpendicular to the axial dimension which preferably is at least twice the thickness of the formed paper web 1 at the web-detaching point 10.

Figure 6:
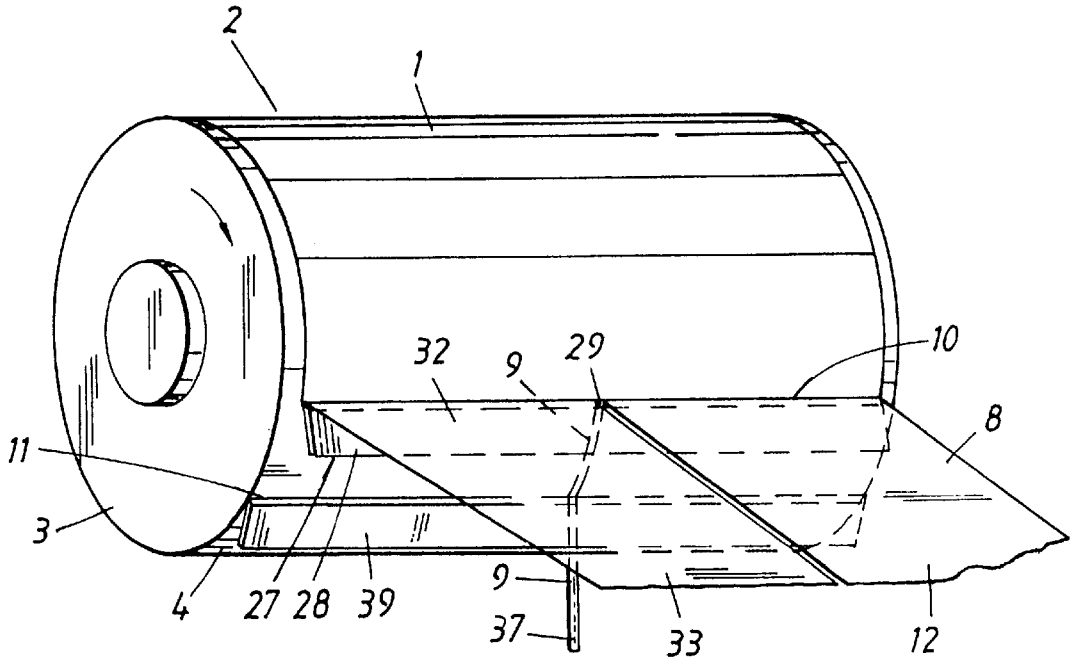
FIG. 6 is a perspective view of a drying cylinder with a apparatus according to a fifth embodiment of the invention.

The embodiment shown in FIG. 6 is similar to that in FIG. 5 except that no edge trimmings are obtained since the doctor blade 28 of the creping doctor 27 is extended up to and slightly past the side edges of the formed paper web. The formed paper web 1 is thus in this case divided into three partial-width webs by the first partial-width web 8 and the third partial-width web 32 being creped off at the first web-detaching point 10 axially spaced from each other, to obtain two creped paper webs 12, 33 of the same width or different predetermined widths, while the second partial-width web 9 formed between the first partial-width web 8 and the third partial-width web 32 by the double splitting, still adhered to the outer surface 4, accompanies this surface to the second web-detaching point 11 to be detached by means of a doctor blade 39 to obtain an intermediate trimming 37.

Each corner portion 40 (see FIG. 7) of a doctor blade 14, 23, 28 (shown in FIGS. 2,3 and 6 respectively), producing a division is defined by the scraping edge 15, 24(shown in FIGS. 2 and 3 respectively), 30, 31 and a cross edge 41, 42 thereof, the scraping edge and the cross edge forming a right angle with each other and meeting in a point to achieve maximum cutting effect. Said cross edges are thus formed by each end edge of the doctor blade that is situated at a dividing point, and also by each side edge of the recess 29, as shown in FIG. 7.

In conjunction with such a right-angled corner portion 40, and in line with said cross edge 41, 42, an application apparatus (not shown) may be arranged to apply a thin water jet onto the formed paper web, immediately before the cutting tip of the doctor blade, so that the web is moistened somewhat in the following dividing line without affecting the fiber structure. The water jet provides a moist dividing indication which facilitates dividing of the formed paper web with the cutting tip of the doctor blade and ensures that the partial-width web not scraped off does not loosen from the adhesive coating within the dividing area.

The distance between the two web-detaching points 10, 11, or between two consecutive web-detaching points if there are more than two, may vary as desired. The smallest distance that can be used is very small, i.e. a few mm, at least 2 mm, for instance, which can be sufficient to achieve the desired dividing action. According to an alternative embodiment (not shown) for FIG. 3, for instance, two doctor blades are arranged after each other and end to end such that each crepes off one partial-width web 8, 9. The doctor blades are then somewhat displaced in circumferential direction in relation to each other, e.g., at least 2 mm, so that cutting of the formed paper web has time to take place before the web reaches the second doctor blade forming the second web-detaching point. The doctor blades are suitably located in different planes forming an acute angle with each other so that they can be mounted with the same angle of contact. However, different angles of contact may be used for the two doctor blades for different creping situations, even if the blades are in different planes. If the distance between the two web-detaching points is small, it is advantageous to arrange two doctor blades in a single common support body with a separately adjustable holder for each doctor blade. In an alternative embodiment, the two doctor blades are arranged in the same support body and the same holder, the doctor blades having different heights in order to obtain said distance of at least 2 mm between the two web-detaching points.

In the embodiments shown, the formed paper web is transferred to a drying cylinder, e.g., a Yankee dryer, in which case the creping is performed as dry creping. Creping can also be performed as wet creping and in this case the formed paper web is transferred to a cylinder with a smooth outer surface that does not have the drying capacity of the drying cylinder. Drying is subsequently performed using through-blow technique.

The invention is not limited to any particular type of paper machine. Any machine can be used that is designed for the manufacture of creped material including cellulosic fiber material and synthetic fiber material.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of dividing a running fibrous web having a width into at least two partial-width portions along a dividing line therebetween extending longitudinally along a running direction of the web, comprising:

wrapping the web circumferentially about an outer surface of a rotating cylinder and holding the web fixed against the outer surface such that the web is transported in the running direction by rotation of the cylinder;

removing one partial-width portion of the web from the rotating cylinder at a first web-detaching point;

removing another partial-width portion of the web from the rotating cylinder at a second web-detaching point;

the first and second web-detaching points being circumferentially spaced apart such that the two partial-width portions of the web are removed from the cylinder at different times so as to cause the web to be divided along the dividing line separating the two portions.

2. The method of claim 1, wherein the web is adhered to the outer surface of the rotating cylinder and the two partial-width portions of the web are removed from the outer surface by scraping.

3. The method of claim 1, wherein removing one of the partial-width portions of the web from the cylinder comprises removing an edge portion of the web.

4. The method of claim 3, wherein the other partial-width portion of the web is creped as it is removed from the cylinder.

5. The method of claim 1, further comprising removing a third partial-width portion of the web from the rotating cylinder at a web-detaching point circumferentially spaced from at least one of the first and second web-detaching points such that the third partial-width portion of the web is divided from at least one of the other two partial-width portions.

6. The method of claim 5, wherein removing the one partial-width portion of the web comprises scraping and creping an interior portion of the web from the rotating cylinder at one circumferential location of the cylinder and removing opposite edge portions of the web from the cylinder at other locations circumferentially spaced from the one location so as to divide the interior portion from the opposite edge portions.

7. The method of claim 6, wherein the one partial-width portion of the web is removed and creped by a first doctor blade located at a first circumferential position and having a length less than the width of the web on the cylinder, and wherein the edge portions of the web are removed from the cylinder by at least a second doctor blade located at a second circumferential position spaced from the first position.

8. The method of claim 1, wherein the web is divided into three partial-width webs by removing a first partial-width web and a third partial-width web from the cylinder at the first web-detaching point such that the first and third partial-width webs are spaced from each other in a length direction of the cylinder so as to divide the first and third partial-width webs from a second partial-width web disposed between the first and third partial-width webs, the second partial-width web remaining affixed to the cylinder and being subsequently removed from the cylinder.

9. The method of claim 8, wherein the first and third partial-width webs are creped as they are removed from the cylinder.

10. The method of claim 8, further comprising dividing each of the first and third partial-width webs into two partial-width webs by removing an edge portion from each at a location circumferentially spaced from the first web-detaching point, so as to divide the web into five partial-width webs.

11. The method of claim 1, wherein the first and second web-detaching points are spaced apart at least about 2 mm along a circumferential direction of the cylinder outer surface.

* * * * *